US006579098B2

(12) United States Patent
Shechter

(10) Patent No.: US 6,579,098 B2
(45) Date of Patent: Jun. 17, 2003

(54) LASER TRANSMITTER ASSEMBLY CONFIGURED FOR PLACEMENT WITHIN A FIRING CHAMBER AND METHOD OF SIMULATING FIREARM OPERATION

(75) Inventor: Motti Shechter, Potomac, MD (US)

(73) Assignee: Beamhit, LLC, Columbia, MD (US)

( * ) Notice: Subject to any disclaimer, the term of this patent is extended or adjusted under 35 U.S.C. 154(b) by 19 days.

(21) Appl. No.: 09/760,610

(22) Filed: Jan. 16, 2001

(65) Prior Publication Data

US 2002/0057719 A1 May 16, 2002

Related U.S. Application Data

(60) Provisional application No. 60/175,882, filed on Jan. 13, 2000.

(51) Int. Cl.[7] ..... F41G 3/26
(52) U.S. Cl. ..... 434/21
(58) Field of Search ..... 434/21

(56) References Cited

U.S. PATENT DOCUMENTS

| | | | |
|---|---|---|---|
| 2,023,497 | A | 12/1935 | Trammell |
| 2,934,634 | A | 4/1960 | Hellberg |
| 3,452,453 | A | 7/1969 | Ohlund |
| 3,510,965 | A | 5/1970 | Rhea |
| 3,526,972 | A | 9/1970 | Sumpf |
| 3,590,225 | A | 6/1971 | Murphy |
| 3,633,285 | A | 1/1972 | Sensney |
| 3,782,832 | A | 1/1974 | Hacskaylo |
| 3,792,535 | A | 2/1974 | Marshall et al. |
| 3,938,262 | A | 2/1976 | Dye et al. |
| 3,995,376 | A | 12/1976 | Kimble et al. |
| 3,996,674 | A | 12/1976 | Pardes et al. |
| 4,048,489 | A | 9/1977 | Giannetti |
| 4,102,059 | A | 7/1978 | Kimble et al. |
| 4,164,081 | A | 8/1979 | Berke |
| 4,177,580 | A | 12/1979 | Marshall et al. |
| 4,195,422 | A | 4/1980 | Budmiger |
| 4,269,415 | A | 5/1981 | Thorne-Booth |
| 4,281,993 | A | 8/1981 | Shaw |
| 4,290,757 | A | 9/1981 | Marshall et al. |
| 4,313,272 | A | 2/1982 | Matthews |
| 4,313,273 | A | 2/1982 | Matthews et al. |
| 4,336,018 | A | 6/1982 | Marshall et al. |
| 4,340,370 | A | 7/1982 | Marshall et al. |
| 4,352,665 | A | 10/1982 | Kimble et al. |
| 4,367,516 | A | 1/1983 | Jacob |
| 4,452,458 | A | 6/1984 | Timander et al. |
| 4,553,943 | A | 11/1985 | Ahola et al. |
| 4,561,849 | A | 12/1985 | Eichweber |

(List continued on next page.)

FOREIGN PATENT DOCUMENTS

| | | | |
|---|---|---|---|
| CH | 204889 | | 5/1939 |
| DE | 3537323 | | 4/1987 |
| DE | 3631081 | A1 | 3/1988 |
| EP | 0 285-586 | A2 | 10/1988 |
| EP | 0 401 731 | | 6/1990 |
| GB | 2254403 | | 10/1992 |
| GB | 2284 253 | A | 5/1995 |
| JP | 2-101398 | A | 4/1990 |
| SU | 1817825 | A3 | 5/1993 |
| WO | WO 91/09266 | | 6/1991 |
| WO | WO 92/08093 | | 5/1992 |
| WO | WO 94/03770 | | 2/1994 |
| WO | WO 94/15165 | | 7/1994 |
| WO | WO 99/10700 | | 3/1999 |

*Primary Examiner*—Joe H Cheng
*Assistant Examiner*—John L Sotomayor

(57) ABSTRACT

A laser transmitter assembly of the present invention is configured for placement within a firing chamber of a user firearm and to have minimal interference with a firearm extractor during charging of the firearm. The laser assembly emits a beam of laser light toward a firearm laser training system target in response to actuation of the firearm trigger to simulate firearm operation. Further, the laser assembly is manufactured to project a concentric laser beam relative to the firearm barrel, thereby enabling use without having to align the assembly with the firearm bore sight.

77 Claims, 4 Drawing Sheets

U.S. PATENT DOCUMENTS 4,583,950 A 4/1986 Schroeder
4,592,554 A 6/1986 Gilbertson
4,619,616 A 10/1986 Clarke
4,640,514 A 2/1987 Myllyla et al.
4,657,511 A 4/1987 Allard et al.
4,662,845 A 5/1987 Gallagher et al.
4,678,437 A 7/1987 Scott et al.
4,680,012 A 7/1987 Morley et al.
4,695,256 A 9/1987 Eichweber
4,737,106 A 4/1988 Laciny
4,761,907 A 8/1988 De Bernardini
4,786,058 A 11/1988 Baughman
4,788,441 A 11/1988 Laskowski
4,804,325 A 2/1989 Willits et al.
4,811,955 A 3/1989 De Bernardini
4,830,617 A 5/1989 Hancox et al.
4,922,401 A 5/1990 Lipman
4,947,859 A 8/1990 Brewer et al.
4,948,371 A 8/1990 Hall
4,983,123 A 1/1991 Scott et al.
4,988,111 A 1/1991 Gerlizt et al.
5,004,423 A 4/1991 Bertrams
5,064,988 A 11/1991 E'nama et al.
5,092,071 A 3/1992 Moore
5,095,433 A 3/1992 Botarelli et al.
5,119,576 A 6/1992 Erning
5,140,893 A 8/1992 Leiter
5,153,375 A 10/1992 Eguizabal
5,179,235 A 1/1993 Toole
5,194,006 A 3/1993 Zaenglein, Jr.
5,194,007 A 3/1993 Marshall et al.
5,213,503 A 5/1993 Marshall et al.
5,237,773 A 8/1993 Claridge
5,281,142 A 1/1994 Zaenglein, Jr.
5,328,190 A 7/1994 Dart et al.
5,344,320 A 9/1994 Inbar et al.
5,365,669 A 11/1994 Rustick et al.
5,366,229 A 11/1994 Suzuki
5,413,357 A 5/1995 Schulze et al.
5,433,134 A 7/1995 Leiter
5,474,452 A 12/1995 Campagnuolo
5,488,795 A 2/1996 Sweat
5,585,589 A 12/1996 Leiter
5,591,032 A 1/1997 Powell et al.
5,605,461 A 2/1997 Seeton
5,641,288 A 6/1997 Zaenglein, Jr.
5,672,108 A 9/1997 Lam et al.
5,685,636 A 11/1997 German
5,716,216 A 2/1998 O'Loughlin et al.
5,740,626 A 4/1998 Schuetz et al.
5,788,500 A 8/1998 Gerber
5,842,300 A 12/1998 Cheshelski et al.
5,947,738 A 9/1999 Muehle et al.
6,146,141 A * 11/2000 Schumann ..... 434/11
6,315,568 B1 * 11/2001 Hull et al. ..... 273/365
6,322,365 B1 * 11/2001 Shechter et al. ..... 434/19

* cited by examiner

LASER TRANSMITTER ASSEMBLY CONFIGURED FOR PLACEMENT WITHIN A FIRING CHAMBER AND METHOD OF SIMULATING FIREARM OPERATION

CROSS-REFERENCE TO RELATED APPLICATIONS

This application claims priority from U.S. Provisional patent application Ser. No. 60/175,882, entitled "Laser Transmitter Assembly Configured for Placement Within a Firing Chamber to Simulate Firearm Operation" and filed Jan. 13, 2000. The disclosure of that provisional application is incorporated herein by reference in its entirety.

BACKGROUND OF THE INVENTION

1. Technical Field

The present invention pertains to laser transmitter assemblies for firearm training systems. In particular, the present invention pertains to a laser transmitter assembly configured for placement within a firing chamber of a firearm for projecting a laser beam therefrom in response to trigger actuation to simulate firearm operation.

2. Discussion of the Related Art

Firearms are utilized for a variety of purposes, such as hunting, sporting competition, law enforcement and military operations. The inherent danger associated with firearms necessitates training and practice in order to minimize the risk of injury. However, special facilities are required to facilitate practice of handling and shooting the firearm. These special facilities basically confine projectiles propelled from the firearm within a prescribed space, thereby preventing harm to the surrounding area. Accordingly, firearm trainees are required to travel to the special facilities in order to participate in a training session, while the training sessions themselves may become quite expensive since each session requires new ammunition for practicing handling and shooting of the firearm.

The related art has attempted to overcome the above-mentioned problems by utilizing laser or other light energy with firearms to simulate firearm operation. For example, U.S. Pat. No. 3,633,285 (Sesney) discloses a laser transmitting device for markmanship training. The device is readily mountable to the barrel of a firearm and transmits a light beam upon actuation of the firearm firing mechanism. The laser device is triggered in response to an acoustical transducer detecting sound energy developed by the firing mechanism. The light beam is detected by a target having a plurality of light detectors, whereby an indication of aim accuracy may be obtained.

U.S. Pat. No. 3,792,535 (Marshall et al) discloses a marksmanship training system including a laser beam transmitter and receiver mounted on a rifle barrel and a target having retroreflective means of different sizes. The retroflective means redirect the laserbeam from the target to the receiver, thereby providing immediate information relating to a hit or miss of the target when the rifle trigger is depressed.

U.S. Pat. No. 4,640,514 (Myllyla et al) discloses a target practice apparatus having a transmitter/receiver attachable to the distal end of a conventional firearm barrel for emitting an optical beam toward an optical target offset from an intended target. The optical target is distinguished from the intended target and surroundings due to its different optic radiation reflecting properties. The receiver determines a hit or miss of the intended target based on a return beam that indicates when the optical beam impacts the optical target.

Although the above-described systems simulate firearm operation, these systems suffer from several disadvantages. In particular, the laser or light energy transmission devices are attached to or mounted on external surfaces of a firearm. As such, these devices require additional fastening or clamping mechanisms to secure the devices to the firearm, thereby increasing system costs. Further, the fastening of the devices to the firearm provides an additional task for operators, thereby complicating the procedure for firearm training and for transitioning the firearm between simulation and actual firing modes. In addition, since the position of the transmission devices is offset from the barrel or firearm point of aim, various adjustments and/or target configurations are generally required to correlate the emitted beam with the point of aim of the firearm, thereby further complicating the simulation procedure.

In an attempt to overcome the above-mentioned deficiencies, the related art has utilized devices for emitting laser or other light energy within the firearm interior to simulate firearm operation. For example, U.S. Pat. No. 3,938,262 (Dye et al) discloses a laser weapon simulator that utilizes a laser transmitter in combination with a rifle to teach marksmanship by firing laser bullets at a target equipped with an infrared detector. A cartridge-shaped member includes a piezoelectric crystal, a laser transmitter circuit and optics. An end cap and plunger are mounted at a primer end of the cartridge by a spring, while the crystal is mounted within the cartridge adjacent the plunger. The cartridge is placed in the rifle breach, whereby the rifle hammer strikes the plunger in response to trigger actuation. The plunger subsequently strikes the piezoelectric crystal to power the laser transmitter circuit and emit an output pulse.

U.S. Pat. No. 4,678,437 (Scott et al) discloses a marksmanship training apparatus that provides for simulated firing of projectile-type weapons. The apparatus includes a substitute cartridge and a receiver/detector target device. The substitute cartridge is self-contained and includes a power source, an energy emitting device that emits pulses of energy, a lens device to concentrate the emitted energy, an energy activation device and a transfer device to transfer energy from the weapon firing mechanism to the energy activation device. The energy activation device includes a snap-action type switch having a movable terminal and a stationary terminal. The transfer device transfers energy imparted by the firing mechanism to the energy activation device by forcing the movable terminal in contact with the stationary terminal, thereby activating the energy emitting device to emit pulses of energy.

U.S. Pat. No. 4,830,617 (Hancox et al) discloses an apparatus for simulated shooting including two separable sections. A first section includes a piezoelectric unit producing a pulse of high voltage when the firing pin of a gun strikes the end of that unit, a power source and an electronic unit including a pulse generator. The second unit houses an infrared light emitting diode (LED) to emit a beam of radiation through a lens that concentrates the beam for a selected range. The sections interconnect via a pin socket and plug arrangement. When the firing pin activates the piezoelectric unit, the resultant pulse triggers a monostable circuit controlling the pulse generator. The pulses produced by the pulse generator are fed into an amplifier to produce current pulses that are provided to the light emitting diode for emission of the beam through the lens and to a target.

U.S. Pat. No. 5,605,461 (Seeton) discloses a laser device for simulating firearm operation. The device includes a piezoelectric crystal for detecting high amplitude acoustic pulses generated in response to actuation of a firearm firing mechanism. An amplitude detecting circuit receives a voltage pulse from the piezoelectric crystal and causes a laser diode to be energized in response to the pulse exceeding a threshold. The laser diode is activated for an amount of time sufficient to enable a laser spot to be visible to a user and to permit a streak to be developed when the firearm is pulled slightly during trigger activation. The device may be mounted under the barrel of the firearm or encased in a housing shaped like a flanged cartridge for insertion into the rear of the firearm barrel by temporarily removing the firearm slide.

The above-described systems emitting energy from within the firearm interior similarly suffer from several disadvantages. Specifically, the Dye et al system utilizes the piezoelectric crystal to power the laser transmitter circuit. This may lead to erratic transmissions, since the hammer may not consistently provide sufficient force for the crystal to produce the proper operating voltage. The Scott et al device employs a switch having moving components to facilitate transmission of an energy pulse in response to activation of the firing mechanism. However, these types of switches tend to be problematic over time and degrade device reliability. Further, the Hancox et al apparatus employs two separable sections that may become dislodged due to the force exerted by the firing pin impact. Accordingly, the firearm simulation may be repeatedly interrupted to reconnect the dislodged sections in order to resume or continue the simulation. Moreover, the above-described systems within the firearm interior do not ensure transmission of a concentric beam relative to the firearm barrel, thereby enabling offsets or inaccuracies to occur between the beam and point of aim of the firearm and reducing simulation accuracy. In addition, these systems generally include transmission devices having configurations that tend to interfere with a firearm extractor. Thus, the transmission devices may be ejected or displaced by the extractor during charging of the firearm, thereby requiring repositioning within and/or alignment with the firearm for each shot.

OBJECTS AND SUMMARY OF THE INVENTION

Accordingly, it is an object of the present invention to simulate firearm operation via a laser transmitter assembly configured for rapid insertion into and removal from a firearm.

It is another object of the present invention to simulate firearm operation via a laser transmitter assembly configured for placement within a firearm firing chamber.

Yet another object of the present invention is to simulate firearm operation via a laser transmitter assembly that emits a concentric laser beam relative to a firearm barrel to provide enhanced simulation accuracy.

Still another object of the present invention is to simulate firearm operation via a laser transmitter assembly configured for placement within a firearm firing chamber and for minimal interference with a firearm extractor to maintain proper positioning of the transmitter assembly during changing of the firearm.

A further object of the present invention is to manufacture a laser transmitter assembly for simulating firearm operation in a manner that ensures transmission of a concentric beam relative to a firearm barrel to provide enhanced simulation accuracy.

The aforesaid objects are achieved individually and in combination, and it is not intended that the present invention be construed as requiring two or more of the objects to be combined unless expressly required by the claims attached hereto.

According to the present invention, a laser transmitter assembly is configured for placement within a firing chamber of a user firearm and to have minimal interference with a firearm extractor during charging of the firearm. The laser assembly emits a beam of laser light toward a firearm laser training system target in response to actuation of the firearm trigger to simulate firearm operation. Further, the laser assembly is manufactured to project a concentric laser beam relative to the firearm barrel, thereby enabling use without having to align the assembly with the firearm bore sight.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
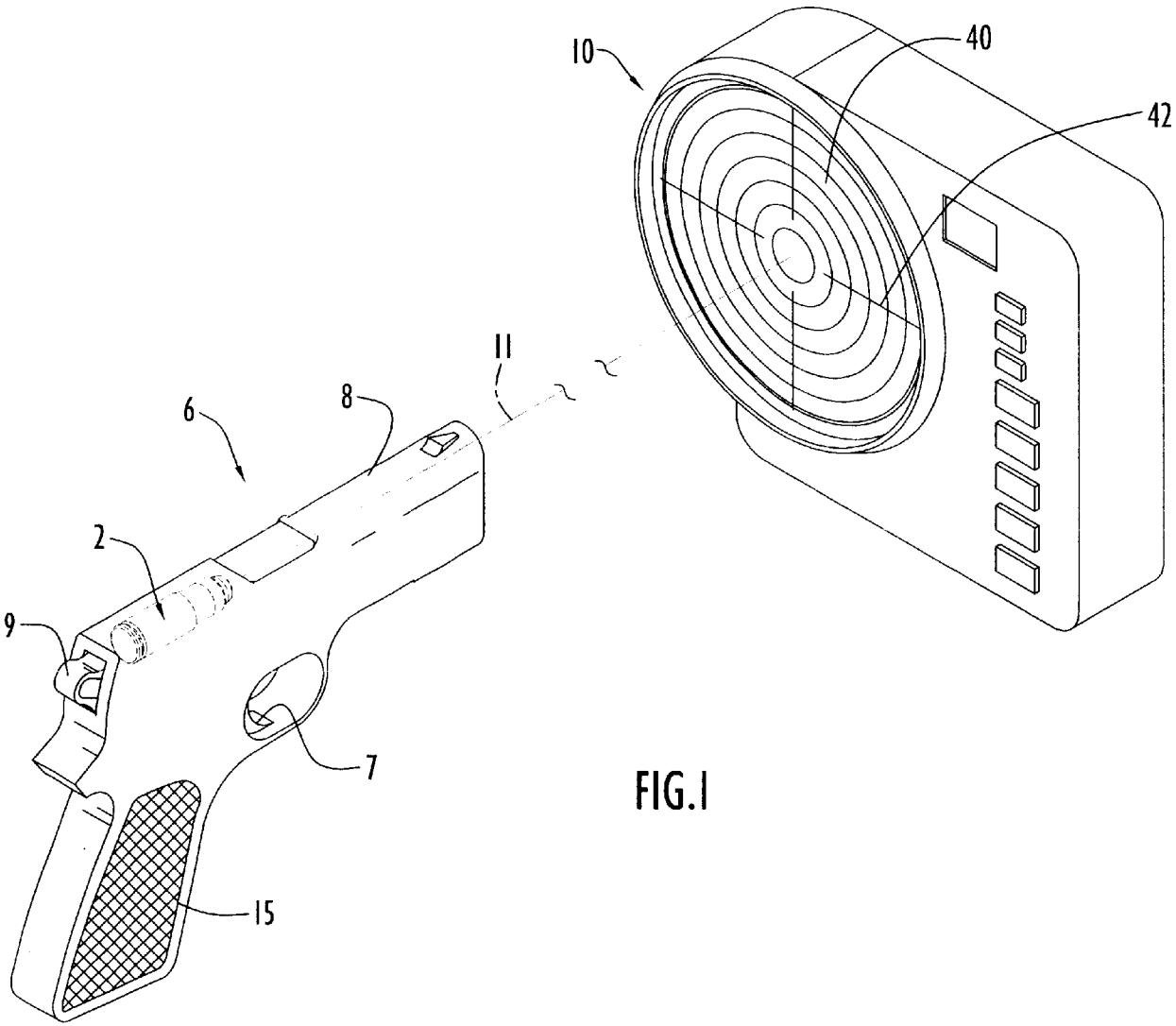
FIG. 1 is a view in perspective of a firearm laser training system employing a laser transmitter assembly to direct a laser beam from a firearm onto a target according to the present invention.

A firearm laser training system according to the present invention is illustrated in FIG. 1. Specifically, the firearm laser training system includes a laser transmitter assembly 2 and a target 10. The laser transmitter assembly is configured for placement within an unloaded user firearm 6 to adapt the firearm to project laser pulses in response to trigger actuation. By way of example only, firearm 6 is implemented by a conventional hand-gun and includes a trigger 7, a barrel 8, a hammer 9 and a grip 15. However, the firearm may be implemented by any conventional firearms (e.g., hand-gun, rifle, shotgun, etc). Laser assembly 2 is placed within a firing chamber of firearm 6 and emits a beam 11 of visible or invisible (e.g. infrared) modulated laser light in the form of a pulse in response to actuation of trigger 7. The laser beam may further be coded to enable identification of the beam source when the system is accommodating plural users. A user aims unloaded firearm 6 at target 10 and actuates trigger 7 to project laser beam 11 from laser transmitter assembly 2 through barrel 8 toward the target. Target 10 is used in conjunction with signal processing circuitry adapted to detect the modulated or coded laser beam. The target, by way of example, includes a visible circular bull's eye 40 with quadrant dividing lines 42, and detectors disposed across the target surface to detect the beam.

A computer system (not shown) analyzes detection signals from the detectors and provides feedback information via a display and/or printer (not shown). The target is similar to the targets disclosed in U.S. patent application Ser. No. 09/486,342, entitled "Network-Linked Laser Target Firearm Training System" and filed Feb. 25, 2000, the disclosure of which is incorporated herein by reference in its entirety. The computer system may be connected with other systems over a network (e.g., LAN, WAN, Internet, etc.) to enable joint training or competing sessions as disclosed, by way of example, in the aforementioned U.S. Patent Application. The laser assembly of the present invention maybe utilized to participate in such sessions, while the emitted beam may be modulated and/or encoded to identify the participant to the system. It is to be understood that the terms "top", "bottom", "side", "front", "rear", "back", "lower", "upper", "height", "width", "thickness", "vertical", "horizontal" and the like are used herein merely to describe points of reference and do not limit the present invention to any specific orientation or configuration.

Figure 2:
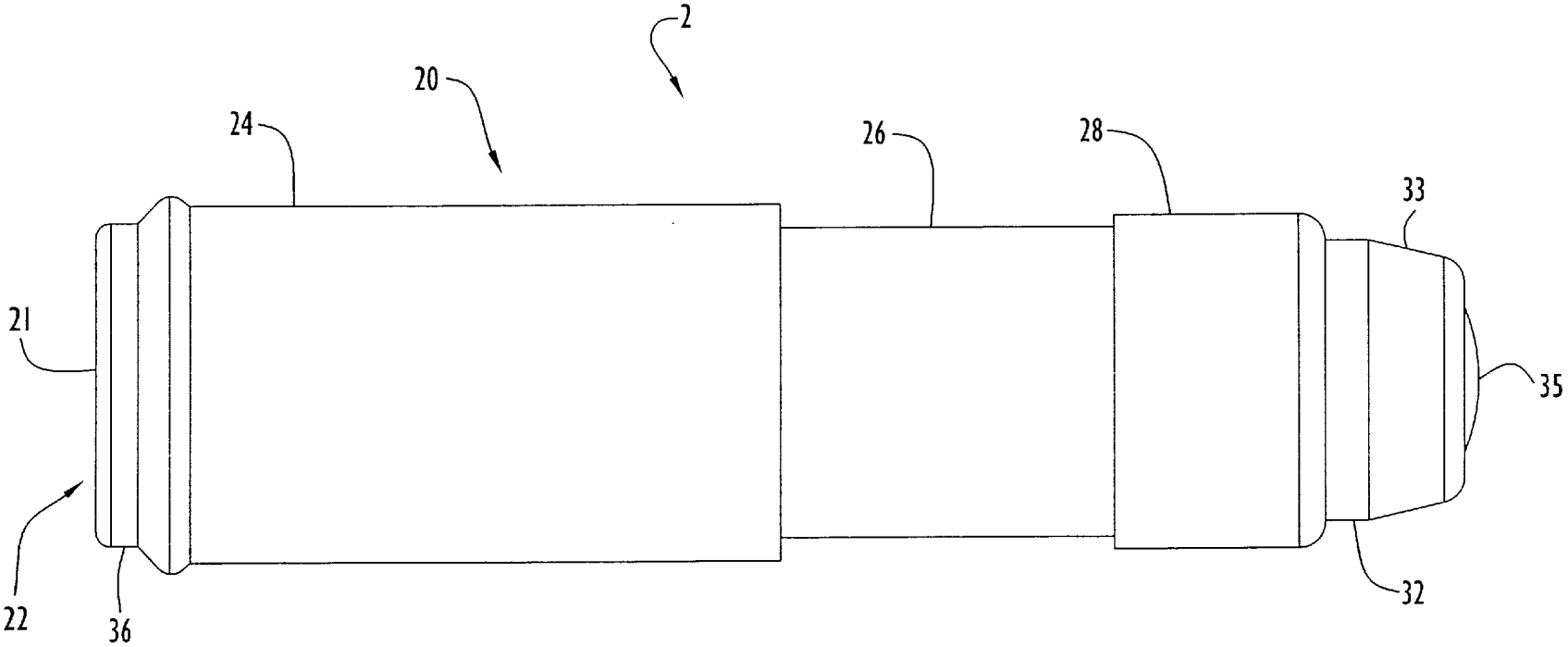
FIG. 2 is a perspective view of the laser transmitter assembly of the system of FIG. 1 according to the present invention.

An exemplary laser transmitter assembly employed by the training system is illustrated in FIG. 2. Specifically, laser assembly 2 includes a housing 20 having the laser assembly components disposed therein. Housing 20 is generally cylindrical and typically constructed of brass, but may be constructed of any suitable materials. The housing is configured to fit within a firing chamber of firearm 6 (e.g., similar to a live projectile) and is machined by rotary action to fit within the firing chamber and be concentric relative to the barrel within specific tolerances (e.g., 0.01 inch for a hand-gun). The laser assembly maybe placed within a firing chamber and utilized without the need to align the laser assembly with the firearm bore sight (e.g., the bore sight is inherently aligned due to the concentric nature of the laser assembly). By way of example only, laser assembly 2 is configured for use with nine millimeter caliber weapons. However, the assembly may be of any shape or size and may be manufactured for use with any type or caliber of firearm (e.g., hand-gun, rifle, shotgun, etc.).

The housing includes a base 22, a shell member 24, lower and upper projectile members 26, 28 and a neck 32. Base 22 includes a substantially cylindrical projection 36 extending distally and partially into the confines of shell member 24. The projection includes a diametric groove or slot 21 defined within the projection proximal surface. The base configuration facilitates minimal interaction with a firearm extractor, and prevents displacement and/or ejection of the assembly during charging of the firearm. By way of example only, disk 34 has a transverse cross-sectional dimension often millimeters, while the projection has a cross-sectional dimension of 8.8 millimeters. Shell member 24 is generally cylindrical and is attached to and extends distally from the projection. The transverse cross-sectional dimensions of the shell member are slightly greater than those of projection 36 to partially envelop the projection. The shell member further includes a tapered proximal end to form a tilted shoulder where the projection and shell member meet. The shell member is similar to a shell portion of a corresponding firearm cartridge, and by way of example only, has a transverse cross-sectional dimension of approximately 9.7 millimeters.

Lower projectile member 26 is generally cylindrical and is attached to and extends distally from shell member 24. The transverse cross-sectional dimensions of the lower projectile member are slightly less than those of shell member 24, thereby forming a shoulder where the lower projectile and shell members meet. Lower projectile member 26 is similar to a projectile portion of a firearm cartridge and, by way of example only, has a transverse cross-sectional dimension of approximately 8.8 millimeters. Upper projectile member 28 is generally cylindrical and is attached to and extends distally from lower projectile member 26. The transverse cross-sectional dimensions of the upper projectile member are slightly greater than those of the lower projectile member, thereby forming a slight shoulder where the upper and lower projectile members meet. The upper projectile member has a tapered distal end and joins with neck 32 as described below.

Neck 32 is generally cylindrical and is attached to and extends distally from upper projectile member 28. The transverse cross-sectional dimensions of the neck are less than those of the upper projectile member, thereby forming a shoulder where the upper projectile member and neck meet. By way of example only, the neck has transverse cross-sectional dimensions of approximately seven millimeters. The upper portion of the neck is externally threaded for engaging an optics module 33 having a lens 35 for directing the laser beam. The optics module is manufactured to enable the laser assembly to project a laser beam concentric with firearm barrel 8 as described below, and is typically pre-assembled having internal threads for attachment to neck 32. A series of injection holes (not shown), preferably four, are defined in the optics module for receiving a bonding material to secure the lens in position within that module. In addition, a plurality of adjustment pins, preferably two, are attached to the optics module for adjusting the lens position and direction of the laserbeam. The optics module is maintained out of contact with the firearm barrel when the laser assembly is inserted within the firearm.

Figure 3:
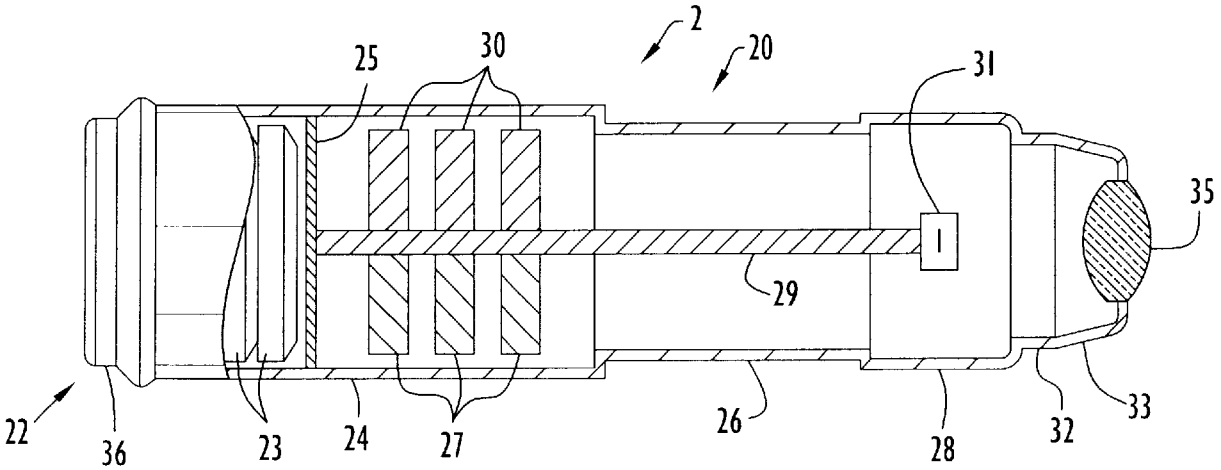
FIG. 3 is a view in elevation and partial section of the laser transmitter assembly of FIG. 2.

Referring to FIG. 3, the laser assembly components are disposed within housing 20 and include button batteries 23 to provide power to the laser assembly, a mechanical wave sensor 25, a modulating and pulsing module 27, a printed circuit board 29, a power supply 30, a laser diode or chip 31 and optics module 33. Button batteries 23, typically four, and sensor 25 are disposed within shell member 24 along with modulating and pulsing module 27 and power supply 30. Upper projectile member 28 contains laser diode 31, while printed circuit board 29 extends between sensor 25 and laser diode 31 and includes conventional circuitry for interconnecting and conveying signals between the assembly electrical components (e.g., sensor 25, module 27, power supply 30, laser diode 31, etc.). However, the laser assembly components may be arranged within the housing in any suitable fashion, and are typically implemented by conventional or commercially available devices. The laser assembly emits a laser beam through optics module 33 toward target 10 or other intended target in response to detection of trigger actuation by mechanical wave sensor 25. Specifically, when trigger 7 (FIG. 1) is actuated, hammer 9 impacts the firearm and generates a mechanical wave which travels distally along firearm 6. As used herein, the term "mechanical wave" or "shock wave" refers to an impulse traveling through the firearm. Alternatively, the hammer may force a firing pin of the firearm to impact the laser assembly and generate a mechanical wave which travels distally along the assembly housing. Mechanical wave sensor 25 within the laser assembly senses the mechanical wave from the hammer and/or firing pin impact and generates a trigger signal. The mechanical wave sensor is preferably implemented by a piezoelectric element, but may alternatively include an accelerometer or a solid state sensor, such as a strain gauge. Module 27 within the laser assembly detects the trigger signal and drives the laser diode to generate and project a pulsed, modulated laser beam from firearm 6, while power supply 30 receives power from batteries 23 to provide appropriate power signals to the assembly electrical components. The laser beam is typically modulated at a frequency of approximately forty kilohertz, while the laser is generally enabled for a predetermined time interval, preferably eight milliseconds, sufficient to account for the effect of any firearm movement after trigger actuation. However, any suitable modulation (e.g., 100 kilohertz) or pulse duration may be utilized.

Alternatively, the laser assembly may employ an acoustic sensor, preferably a microphone, in place of mechanical wave sensor 25 to sense actuation of the trigger and enable emission of a laser pulse. Initially, the hammer impact generates sound or acoustic signals within a particular frequency range. The microphone detects acoustic signals and, in response to the detected signals having a frequency within the range of the hammer impact, generates a trigger signal to activate the laser diode via module 27 as described above. The microphone may include or be coupled to filter circuitry to determine the frequency of detected signals and the occurrence of the hammer impact. The laser assembly is basically similar in function to the laser device disclosed in above-referenced U.S. patent application Ser. No. 09/486,342. The present invention enables actuation of the laser beam by use of a piezoelectric or acoustic sensing element (e.g., without the use of mechanical switches or devices such as a firing pin physically manipulating a switch), thereby providing enhanced reliability over time.

Figure 4:
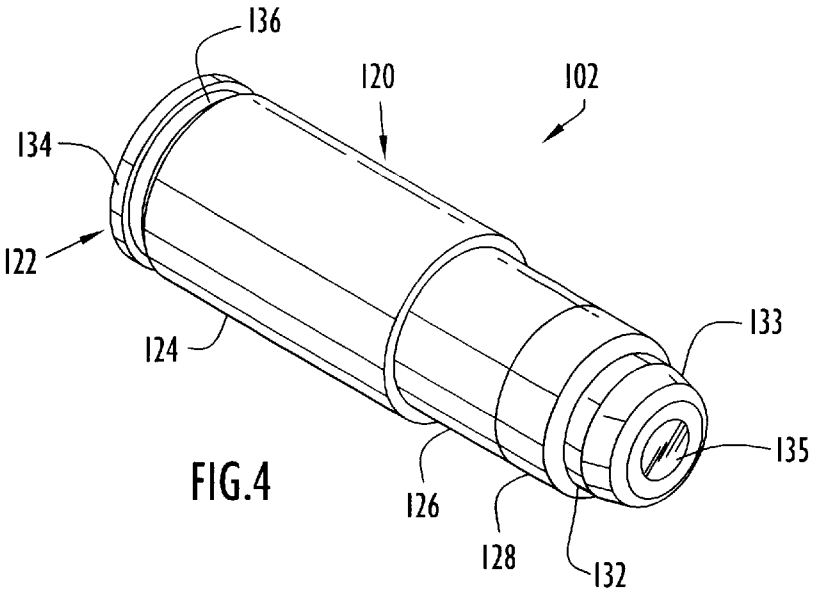
FIG. 4 is a perspective view of an alternative embodiment of the laser transmitter assembly according to the present invention.

An alternative laser transmitter assembly according to the present invention is illustrated in FIG. 4. Specifically, laser assembly 102 is similar to the transmitter assembly described above and includes a housing 120 having the laser assembly components disposed therein. Housing 120 is generally cylindrical and typically constructed of brass, but may be constructed of any suitable materials. The housing is configured to fit within a firing chamber of firearm 6 (e.g., similar to a live projectile) and is machined by rotary action to fit within the firing chamber and be concentric relative to the barrel within specific tolerances (e.g., 0.01 inch for a hand-gun). The laser assembly may be placed within a firing chamber and utilized without the need to align the laser assembly with the firearm bore sight (e.g., the bore sight is inherently aligned due to the concentric nature of the laser assembly). By way of example only, laser assembly 102 is configured for use with nine millimeter caliber weapons, and includes a height of approximately thirty-four millimeters. However, the assembly may be of any shape or size and maybe manufactured for use with any type or caliber of firearm (e.g., hand-gun, rifle, shotgun, etc.).

The housing includes a base 122, a shell member 124, lower and upper projectile members 126, 128 and a neck 132. Base 122 includes a substantially circular disk 134 having a substantially cylindrical projection 136 attached to the disk. The projection extends distally from the disk and partially into the confines of shell member 124. The transverse cross-sectional dimensions of the projection are slightly less than those of disk 134, thereby forming a shoulder where the projection and disk meet. By way of example only, disk 134 has a transverse cross-sectional dimension of ten millimeters, while the projection has a cross-sectional dimension of 8.8 millimeters. Shell member 124 is generally cylindrical and is attached to and extends distally from the projection. The transverse cross-sectional dimensions of the shell member are slightly greater than those of projection 136 to partially envelop the projection. The shell member further includes a tapered proximal end to form a tilted shoulder where the projection and shell member meet. The shell member is similar to a shell portion of a corresponding firearm cartridge, and by way of example only, has a transverse cross-sectional dimension of approximately 9.7 millimeters.

Lower projectile member 126 is generally cylindrical and is attached to and extends distally from shell member 124. The transverse cross-sectional dimensions of the lower projectile member are slightly less than those of shell member 124, thereby forming a shoulder where the lower projectile and shell members meet. By way of example only, lower projectile member 126 has a transverse cross-sectional dimension of approximately 8.8 millimeters. Upper projectile member 128 is generally cylindrical and is attached to and extends distally from lower projectile member 126. The upper and lower projectile members have substantially similar transverse cross-sectional dimensions and are similar to a projectile portion of a firearm cartridge. The upper projectile member has a tapered distal end and joins with neck 132 as described below.

Neck 132 is generally cylindrical and is attached to and extends distally from upper projectile member 128. The transverse cross-sectional dimensions of the neck are less than those of the upper projectile member, thereby forming a shoulder where the upper projectile member and neck meet. By way of example only, the neck has transverse cross-sectional dimensions of approximately seven millimeters. The upper portion of the neck is externally threaded for engaging an optics module 133 having a lens 135 for directing the laser beam. The optics module is manufactured to enable the laser assembly to project a laser beam concentric with firearm barrel 8 as described below, and is typically pre-assembled having S internal threads for attachment to neck 132. A series of injection holes (not shown), preferably four, are defined in the optics module for receiving a bonding material to secure the lens in position within that module. In addition, a plurality of adjustment pins, preferably two, are attached to the optics module for adjusting the lens position and direction of the laser beam. The optics module is maintained out of contact with the firearm barrel when the laser assembly is inserted within the firearm. The laser transmitter assembly includes substantially the same components and component arrangement and operates in substantially the same manner as assembly 2 described above.

Figure 5:
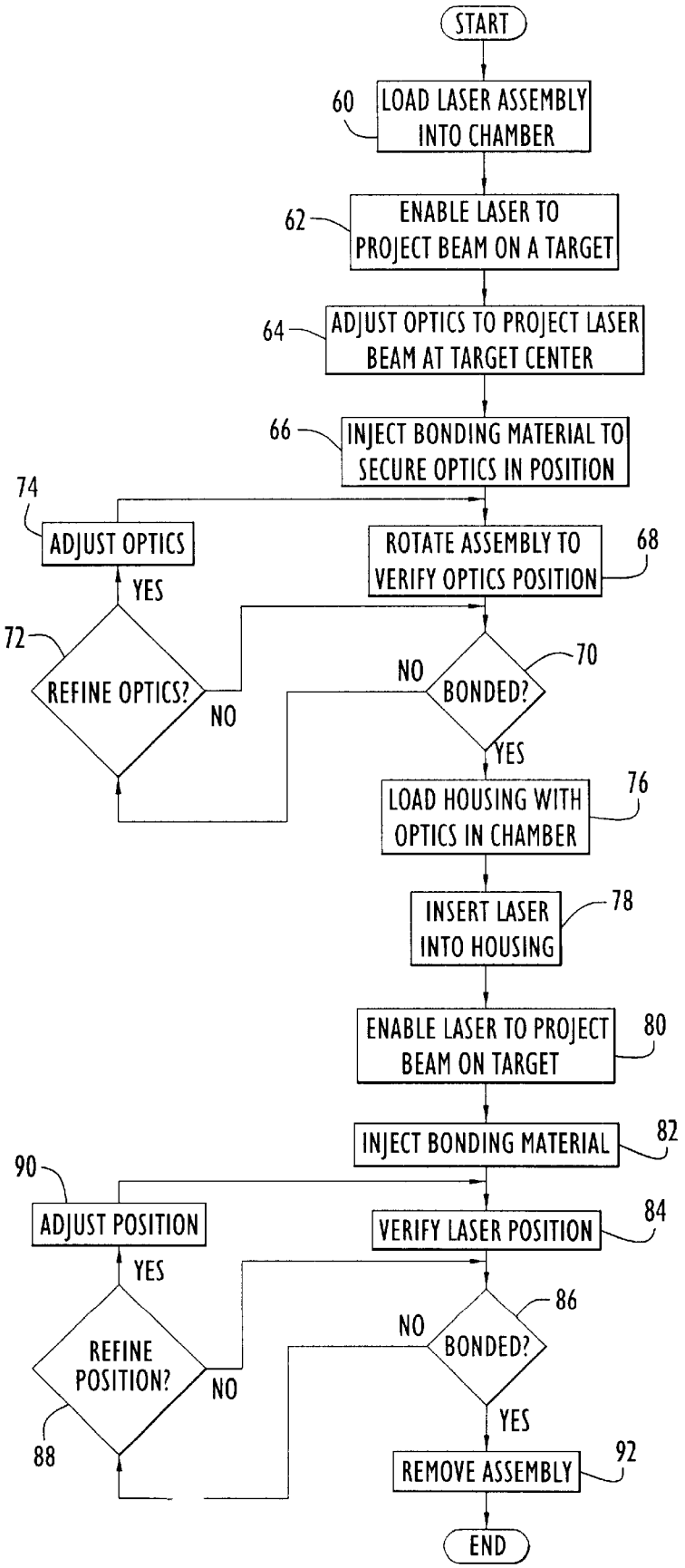
FIG. 5 is a procedural flow chart illustrating the manner in which a laser transmitter assembly is manufactured to project a concentric laser beam relative to a firearm barrel according to the present invention.

The laser transmitter assemblies described above are manufactured to produce a laser beam concentric with the firearm barrel, thereby enabling use of a laser assembly without having to align the assembly with the firearm bore sight. An exemplary manner of manufacturing a laser assembly is illustrated with reference to FIGS. 2 and 5. Basically, the technique includes adjusting the lens position within the optics module, and subsequently modifying the position of the laser within the assembly to direct the emitted beam in an accurate manner. Specifically, laser assembly 2 having optics module 33 attached thereto is disposed in a chamber at step 60. The laser components are removably disposed within the assembly and provide a laser beam for adjustment of the position of optics module lens 35. The laser assembly is enabled at step 62 to project a beam through lens 35 and onto a manufacturing target having indicia indicating the approximate center of a firearm barrel. The optics or lens position is adjusted at step 64, via the adjustment pins, to project the beam precisely on the target indicia or, in other words, along the simulated barrel center.

Once the optics have been adjusted, bonding material is injected into the optics module at step 66, via the injection holes, to secure lens 35 in its current position. The beam produced by the lens position is verified at step 68 by rotating the assembly within the chamber approximately one-hundred eighty degrees and confirming that a projected laser beam spot maintains its position on the target. If the spot does not maintain its position (e.g., moves relative to the target indicia) as determined at step 72, the lens position may be adjusted by pressurized air at step 74 to project the beam at the target indicia. The lens adjustment process may be repeated as necessary until the bonding material sets the lens as determined at step 70. This usually occurs within an interval of approximately fifteen minutes.

In order to provide enhanced accuracy, the position of the laser may further be adjusted to direct the projected beam. In particular, a laser assembly housing having a bonded lens is inserted into the chamber at step 76. Alternatively, the laser adjustment may be performed immediately after the lens has been bonded as described above while the assembly is still in the chamber. The laser components (e.g., batteries, sensor, power supply, modulating and pulsing module, laser diode, etc.) in the form of a module are inserted into or maneuvered within the housing at step 78 via an arm removably fastened to the laser components. The laser is enabled at step 80 and its position adjusted via the arm to project the beam at target indicia as described above. When the laser is positioned to project a beam striking the target indicia, bonding material is injected into the housing at step 82 to secure the laser components module in its current position.

The beam produced by the laser position is verified at step 84 by rotating the laser assembly within the chamber and confirming that a projected laser beam spot maintains its position on the manufacturing target as described above. If the spot does not maintain its position (e.g., moves relative to the target indicia) as determined at step 88, the laser position may be adjusted via the arm at step 90 to project the beam at the target indicia. The laser adjustment process may be repeated as necessary until the bonding material sets the laser components module as determined at step 86. This usually occurs within an interval of approximately fifteen minutes. Once the laser and optics have been bonded, the arm is detached from the laser components module and the assembly is removed from the chamber at step 92. The above-described manufacturing process is preferably automated, may be accomplished by any machining system performing the steps described above and may be applied to any of the above-described laser transmitter assemblies. The manufacturing target may include detectors that identify when the laser and optics are properly adjusted to project a beam impacting the target indicia.

It will be appreciated that the embodiments described above and illustrated in the drawings represent only a few of the many ways of implementing a laser transmitter assembly configured for placement within a firing chamber and method of simulating firearm operation.

The laser transmitter assemblies of the present invention maybe utilized with any type of firearm (e.g., hand-gun, rifle, shotgun, machine gun, etc.), and may be fastened to or within the firearm at any suitable locations via any conventional or other fastening techniques (e.g., frictional engagement with the barrel, etc.). Further, the laser transmitter assemblies may be placed within the firearm at any suitable locations (e.g., barrel, firing chamber, etc.). The system may include a dummy firearm receiving any of the laser assemblies to project a laser beam, or replaceable firearm components (e.g., a barrel) having any of the laser assemblies disposed therein for firearm training. The laser assemblies maybe utilized for firearm training on objects other than the target.

The computer system of the laser training system may be implemented by any type of conventional or other computer system, and may be connected to any quantity of other firearm training computer systems via any type of network or other communications medium to facilitate plural user training sessions or competitions. The computer system may include any type of printing device, display and/or user interface to provide any desired information relating to a user session.

The laser assemblies may be utilized with any types of targets (e.g., targets visibly reflecting the beam, having detectors to detect the beam, etc.) and/or firearm laser training systems, such as those disclosed in the aforementioned patent applications and U.S. Provisional patent application Ser. No. 60/175,829, entitled "Firearm Simulation and Gaming System and Method for Operatively Interconnecting a Firearm Peripheral to a Computer System" and filed Jan. 13, 2000; Ser. No. 60/175,987, entitled "Firearm Laser Training System and Kit Including a Target Structure Having Sections of Varying Reflectivity for Visually Indicating Simulated Projectile Impact Locations" and filed Jan. 13, 2000; Ser. No. 60/205,811, entitled "Firearm Laser Training System and Method Employing an Actuable Target Assembly" and filed May 19, 2000; and Ser. No. 60/210,595, entitled "Firearm Laser Training System and Method Facilitating Firearm Training with Various Targets" and filed Jun. 9, 2000; the disclosures of which are incorporated herein by reference in their entireties. The laser assemblies of the present invention may emit any type of laser beam within suitable safety tolerances. The housings may be of any shape or size to accommodate various calibers or types of firearms, may be constructed of any suitable materials and may be machined to any desired tolerances. The base, shell member, upper and lower projectile members and neck of the respective assembly housings may be of any shape or size, may be constructed of any suitable materials and may contain any quantity and/or combination of assembly components. The base groove may be of any quantity, shape or size, and may be disposed at any suitable locations. The electrical components of the laser assemblies (e.g., batteries, sensor, modulating and pulsing module, circuit board, power supply, laser diode or chip, etc.) may be implemented by any conventional or other devices or circuitry performing the above-described functions and may be arranged within the respective assembly housings in any desired fashion. The laser assemblies may include any conventional or other circuitry to interconnect and/or convey signals between the assembly electrical components. The circuitry may reside on the printed circuit board and/or be disposed in the respective housings in any desired fashion and at any suitable locations. The laser assemblies may include any quantity and/or combination of any of the electrical or other (e.g., optics module) components.

The laser assemblies may include any quantity of any type of suitable lens disposed at any location for projecting the beam, while the optics module may be fastened within or to the laser assembly housings via any conventional or other fastening devices. The optics module may include any quantity of injection holes of any shape or size disposed at any suitable locations, and any quantity of adjustment pins or other adjustment devices of any shape or size disposed at any suitable location.

The laser assemblies may be fastened to or inserted within a firearm or other similar structure (e.g., a dummy, toy or simulated firearm) at any suitable locations (e.g., external or internal of a barrel) and be actuated by a trigger or any other device (e.g., power switch, firing pin, relay, etc.). The laser assemblies may include any type of sensor or detector (e.g., acoustic sensor, piezoelectric element, accelerometer, solid state sensors, strain gauge, microphone, etc.) to detect mechanical or acoustical waves or other conditions signifying trigger actuation. The microphone may be implemented by any type of microphone or other device detecting acoustic signals. The laser assemblies may further include any type of conventional or other processor and/or filtering circuitry (e.g., high-pass filter, low-pass filter, band-pass filter, etc.) for determining the frequency of received acoustic signals to determine the occurrence of trigger actuation. The processor and/or filtering circuitry may reside on the printed circuit board and/or be disposed in the respective housings in any desired fashion and at any suitable locations. The laser beam may be visible or invisible (e.g., infrared) and may be modulated in any fashion (e.g., at any desired frequency or unmodulated) or encoded in any manner to provide any desired information. The laser assemblies may enable a beam for any desired duration and may emit any desired type of energy (e.g., light, infrared, laser, etc.). The laser assemblies may include or be connected to any quantity or types of batteries or other power source.

The manufacturing process steps may be performed in any suitable order and by any system capable of performing the process steps, and may be modified in any manner capable of performing the above-described functions. The lens and laser components maybe bonded by any suitable bonding or adhesive materials requiring any desired interval to bond. A laser assembly may be rotated within the chamber through any desired angles to verify the lens and/or laser components module position. The adjustment process may set either or both of the lens and the laser components module, while the lens and laser components module may be set in any desired order. The lens may be adjusted by pressurized air or any other position adjustment technique. The laser components module may be set at any time interval subsequent to the bonding of the lens. The optics module may include any quantity of injection holes and adjustment pins of any shape or size disposed at any suitable locations. The adjustment pins maybe implemented by any devices capable of adjusting the lens and/or beam direction. The laser components module position may be adjusted by any quantity of arms or other devices that may be of any shape or size, may be constructed of any suitable materials and are removably or otherwise attached to the laser components module at any desired locations.

The manufacturing target may be implemented by any quantity of any type of targets of any shape or size (e.g., targets visibly reflecting the beam, targets having detectors to detect the beam, etc.), and may include any quantity of any type of indicia of any shape or size to verify the beam produced by the position of the lens and/or laser components module. The manufacturing process and chamber may accommodate any quantity of laser assemblies.

From the foregoing description, it will be appreciated that the invention makes available a novel laser transmitter assembly configured for placement within a firing chamber and method of simulating firearm operation wherein a laser transmitter assembly is inserted within a firearm firing chamber to emit a laser beam concentric relative to the firearm barrel in response to trigger actuation to simulate firearm operation.

Having described preferred embodiments of a new and improved laser transmitter assembly configured for placement within a firing chamber and method of simulating firearm operation, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A laser transmission device for use with a firearm to simulate firearm operation in response to actuation of said firearm by a user comprising:

a housing configured in the form of a firearm cartridge for placement within a firing chamber of said firearm and including:

a power source;

a laser transmitter;

a sensor to detect actuation of said firearm and produce an actuation signal in response thereto;

a laser modulation unit responsive to said actuation signal to apply a modulation signal of a specific frequency to a laser signal of said laser transmitter to emit a modulated laser pulse compatible with an intended target responsive to laser signals modulated at said modulation signal frequency; and an optics module to direct said emitted laser pulse from said housing toward said intended target in a substantially concentric fashion relative to a barrel of said firearm absent alignment of said device with a firearm bore sight.

2. The device of claim 1 wherein said power source includes at least one battery.

3. The device of claim 1 wherein said frequency is forty kilohertz.

4. The device of claim 1 wherein said sensor includes a piezoelectric element to produce said actuation signal in response to detecting mechanical waves generated by said firearm actuation and propagating along said firearm.

5. The device of claim 1 wherein said sensor includes an acoustic sensor to produce said actuation signal in response to detecting acoustic signals generated by said firearm actuation.

6. The device of claim 5 wherein said acoustic sensor includes a microphone.

7. The device of claim 1 wherein said optics module includes a lens to direct said emitted laser pulse toward said intended target, wherein said lens is positioned within said optics module in a manner to project said emitted laser pulse in a concentric fashion relative to said barrel of said firearm.

8. The device of claim 7 wherein said optics module includes at least one injection port to facilitate injection of a bonding material during manufacture to secure said lens within said optics module.

9. The device of claim 8 wherein said optics module includes at least one position adjustment member to adjust a position of said lens within said optics module during manufacture to facilitate projection of said emitted laser pulse by said lens in said concentric fashion relative to said firearm barrel.

10. The device of claim 1 wherein said housing is configured to be concentric relative to said barrel of said firearm.

11. The device of claim 1 wherein said housing includes a proximal portion including a non-intrusive configuration with respect to a firearm extractor to maintain a position of said device within said firearm during charging of said firearm.

12. The device of claim 11 wherein said proximal portion includes a cylindrical projection disposed at a housing proximal end and having dimensions sufficient to prevent interference of said device with said firearm extractor during charging of said firearm.

13. A laser transmission device for use with a firearm to simulate firearm operation in response to actuation of said firearm by a user comprising:

a housing configured in the form of a firearm cartridge for placement within a firing chamber of said firearm and including:

a power source;

a laser transmitter;

a sensor to detect actuation of said firearm and produce an actuation signal in response thereto;

a laser control unit to control said laser transmitter in a manner to emit a laser pulse in response to receiving said actuation signal from said sensor; and an optics module to direct said emitted laser pulse from said housing toward an intended target in a substantially concentric fashion relative to a barrel of said firearm absent alignment of said device with a firearm bore sight;

wherein a proximal portion of said housing tapers proximally and forms a non-intrusive configuration with respect to a firearm extractor to maintain a position of said device within said firearm during charging of said firearm.

14. The device of claim 13 wherein said proximal portion includes a cylindrical projection disposed at a housing proximal end and having dimensions sufficient to prevent interference of said device with said firearm extractor during charging of said firearm.

15. The device of claim 13 wherein said sensor includes a piezoelectric element to produce said actuation signal in response to detecting mechanical waves generated by said firearm actuation and propagating along said firearm.

16. The device of claim 13 wherein said sensor includes an acoustic sensor to produce said actuation signal in response to detecting acoustic signals generated by said firearm actuation.

17. The device of claim 16 wherein said acoustic sensor includes a microphone.

18. The device of claim 13 wherein said optics module includes a lens to direct said emitted laser pulse toward said intended target, wherein said lens is positioned within said optics module in a manner to project said emitted laser pulse in a concentric fashion relative to said barrel of said firearm.

19. The device of claim 13 wherein said housing is configured to be concentric relative to said barrel of said firearm.

20. The device of claim 13 wherein said laser control unit includes a modulation unit to control said laser transmitter in a manner to emit a laser pulse modulated at a specific frequency in response to receiving said actuation signal from said sensor.

21. A laser transmission device for use with a firearm to simulate firearm operation in response to actuation of said firearm by a user comprising:

a housing configured in the form of a firearm cartridge for placement within a firing chamber of said firearm and including:

a power source;

a laser transmitter;

a sensor to detect actuation of said firearm and produce an actuation signal in response thereto;

a laser control unit to control said laser transmitter in a manner to emit a laser pulse in response to receiving said actuation signal from said sensor; and an optics module to direct said emitted laser pulse from said housing toward an intended target, wherein said optics module includes a lens positioned in a manner to project said emitted laser pulse in a substantially concentric fashion relative to a barrel of said firearm upon insertion of said device within said firing chamber and absent alignment of said device with a firearm bore sight.

22. The device of claim 21 wherein said sensor includes a piezoelectric element to produce said actuation signal in response to detecting mechanical waves generated by said firearm actuation and propagating along said firearm.

23. The device of claim 21 wherein said sensor includes an acoustic sensor to produce said actuation signal in response to detecting acoustic signals generated by said firearm actuation.

24. The device of claim 23 wherein said acoustic sensor includes a microphone.

25. The device of claim 21 wherein said housing is configured to be concentric relative to said barrel of said firearm.

26. The device of claim 21 wherein said housing includes a proximal portion including a non-intrusive configuration with respect to a firearm extractor to maintain a position of said device within said firearm during charging of said firearm.

27. The device of claim 21 wherein said optics module includes at least one injection port to facilitate injection of a bonding material during manufacture to secure said lens within said optics module.

28. The device of claim 27 wherein said optics module includes at least one position adjustment member to adjust a position of said lens within said optics module during manufacture to facilitate projection of said emitted laser pulse by said lens in said concentric fashion relative to said firearm barrel.

29. The device of claim 21 wherein said laser control unit includes a modulation unit to control said laser transmitter in a manner to emit a laser pulse modulated at a specific frequency in response to receiving said actuation signal from said sensor.

30. A method of simulating firearm operation in response to actuation of said firearm by a user comprising the steps of:

(a) configuring a laser transmission device in the form of a firearm cartridge for placement within a firing chamber of said firearm, wherein said device includes a sensor to detect actuation of said firearm and a laser transmitter;

(b) detecting actuation of said firearm via said sensor and producing an actuation signal in response thereto;

(c) applying a modulation signal of a specific frequency to a laser signal of said laser transmitter in response to said actuation signal to emit a modulated laser pulse compatible with an intended target responsive to laser signals modulated at said modulation signal frequency; and (d) directing said emitted laser pulse from said device toward said intended target in a substantially concentric fashion relative to a barrel of said firearm absent alignment of said device with a firearm bore sight.

31. The method of claim 30 wherein step (c) includes:

(c.1) emitting a laser pulse modulated at a frequency of forty kilohertz in response to said actuation signal.

32. The method of claim 30 wherein said sensor includes a piezoelectric element, and step (b) includes:

(b.1) detecting mechanical waves generated by said firearm actuation and propagating along said firearm via said piezoelectric element and producing said actuation signal in response thereto.

33. The method of claim 30 wherein said sensor includes an acoustic sensor, and step (b) further includes:

(b.1) detecting acoustic signals generated by said firearm actuation via said acoustic sensor and producing said actuation signal in response thereto.

34. The method of claim 30 wherein step (d) includes:

(d.1) directing said emitted laser pulse from said device toward said intended target via a lens and positioning said lens within said laser transmission device in a manner to project said emitted laser pulse in a concentric fashion relative to said barrel of said firearm.

35. The method of claim 30 wherein step (a) includes:

(a.1) configuring said laser transmission device to be concentric relative to said barrel of said firearm.

36. The method of claim 30 wherein step (a) includes:

(a.1) configuring said laser transmission device to include a proximal portion including a non-intrusive configuration with respect to a firearm extractor to maintain a position of said device within said firearm during charging of said firearm.

37. A method of simulating firearm operation in response to actuation of said firearm by a user comprising the steps of:

(a) configuring a laser transmission device in the form of a firearm cartridge for placement within a firing chamber of said firearm, wherein said device includes a sensor to detect actuation of said firearm and a laser transmitter, and wherein said laser transmission device is configured to include a proximal portion tapering proximally and forming a non-intrusive configuration with respect to a firearm extractor to maintain a position of said device within said firearm during charging of said firearm;

(b) detecting actuation of said firearm via said sensor and producing an actuation signal in response thereto;

(c) controlling said laser transmitter in a manner to emit a laser pulse in response to said actuation signal produced by said sensor; and (d) directing said emitted laser pulse from said device toward an intended target in a substantially concentric fashion relative to a barrel of said firearm absent alignment of said device with a firearm bore sight.

38. The method of claim 37 wherein said sensor includes a piezoelectric element, and step (b) includes:

(b.1) detecting mechanical waves generated by said firearm actuations and propagating along said firearm via said piezoelectric element and producing said actuation signal in response thereto.

39. The method of claim 37 wherein said sensor includes an acoustic sensor, and step (b) further includes:

(b.1) detecting acoustic signals generated by said firearm actuation via said acoustic sensor and producing said actuation signal in response thereto.

40. The method of claim 37 wherein step (d) includes:

(d.1) directing said emitted laser pulse from said device toward said intended target via a lens and positioning said lens within said laser transmission device in a manner to project said emitted laser pulse in a concentric fashion relative to said barrel of said firearm.

41. The method of claim 37 wherein step (a) includes:

(a.1) configuring said laser transmission device to be concentric relative to said barrel of said firearm.

42. The method of claim 37 wherein step (c) includes:

(c. 1) controlling said laser transmitter in a manner to emit a laser pulse modulated at a specific frequency in response to said actuation signal produced by said sensor.

43. A method of simulating firearm operation in response to actuation of said firearm by a user comprising the steps of:

(a) configuring a laser transmission device in the form of a firearm cartridge for placement within a firing chamber of said firearm, wherein said device includes a sensor to detect actuation of said firearm and a laser transmitter;

(b) detecting actuation of said firearm via said sensor and producing an actuation signal in response thereto;

(c) controlling said laser transmitter in a manner to emit a laser pulse in response to said actuation signal produced by said sensor; and (d) directing said emitted laser pulse from said device toward an intended target via a lens positioned in a manner to project said emitted laser pulse in a substantially concentric fashion relative to a barrel of said firearm upon insertion of said device into said firing chamber and absent alignment of said device with a firearm bore sight.

44. The method of claim 43 wherein said sensor includes a piezoelectric element, and step (b) includes:

(b.1) detecting mechanical waves generated by said firearm actuation and propagating along said firearm via said piezoelectric element and producing said actuation signal in response thereto.

45. The method of claim 43 wherein said sensor includes an acoustic sensor, and step (b) further includes:

(b.1) detecting acoustic signals generated by said firearm actuation via said acoustic sensor and producing said actuation signal in response thereto.

46. The method of claim 43 wherein step (a) includes:

(a.1) configuring said laser transmission device to be concentric relative to said barrel of said firearm.

47. The method of claim 43 wherein step (a) includes:

(a.1) configuring said laser transmission device to include a proximal portion including a non-intrusive configuration with respect to a firearm extractor to maintain a position of said device within said firearm during charging of said firearm.

48. The method of claim 43 wherein step (c) includes:

(c.1) controlling said laser transmitter in a manner to emit a laser pulse modulated at a specific frequency in response to said actuation signal produced by said sensor.

49. A method of simulating firearm operation by projecting a laser beam from a firearm in a substantially concentric fashion relative to a barrel of said firearm in response to actuation of said firearm by a user comprising the steps of:

(a) configuring a laser transmission device housing to include a laser transmission module removably disposed therein and an optics module including a lens;

(b) activating said laser transmission module to emit a laser beam through said lens and onto a target including indicia;

(c) adjusting a position of said lens relative to said optics module to project said emitted laser beam onto said target indicia and securing said lens in said position;

(d) rotating said laser transmission device housing and verifying said emitted laser beam maintains a beam impact location on said target; and (e) adjusting said lens position relative to said optics module in response to said beam impact location being displaced during said rotation, wherein said lens position is adjusted in a manner to maintain said beam impact location on said target during said rotation.

50. The method of claim 49 further including the steps of:

(f) activating said laser transmission module to emit a laser beam through said adjusted lens and onto said target;

(g) adjusting a position of said laser transmission module relative to said optics module to project said emitted laser beam onto said target indicia and securing said laser transmission module into that position;

(h) rotating said laser transmission device housing and verifying said emitted laser beam maintains a beam impact location on said target; and (i) adjusting said laser transmission module position relative to said optics module in response to said beam impact location being displaced during said rotation, wherein said laser transmission module position is adjusted in a manner to maintain said beam impact location on said target during said rotation.

51. The method of claim 49 wherein said optics module includes at least one injection port to facilitate injection of a bonding material, and step (c) includes:

(c.1) injecting bonding material into said at least one injection port to secure said lens in said position;

wherein steps (d) and (e) are repeated until expiration of a time interval sufficient for said bonding material to secure said lens position or until said adjusted lens position maintains said beam impact location on said target during said rotation.

52. The method of claim 49 wherein said optics module includes at least one position adjustment member, and step (c) includes:

(c.1) adjusting said position of said lens relative to said optics module via said at least one position adjustment member to project said emitted laser beam onto said target indicia.

53. The method of claim 50, wherein step (g) includes:

(g.1) injecting bonding material into said device housing to secure said laser transmission module in said adjusted module position;

wherein steps (h) and (i) are repeated until expiration of a time interval sufficient for said bonding material to secure said laser transmission module position or until said adjusted laser transmission module position maintains said beam impact location on said target during said rotation.

54. The method of claim 50 wherein said laser transmission module includes at least one position adjustment member, and step (g) includes:

(g.1) adjusting a position of said laser transmission module relative to said optics module via said at least one position adjustment member to project said emitted laser beam onto said target indicia.

55. A method of simulating firearm operation by projecting a laser beam from a firearm in a substantially concentric fashion relative to a barrel of said firearm in response to actuation of said firearm by a user comprising the steps of:

(a) configuring a laser transmission device housing to include a laser transmission module removably disposed therein and an optics module including a lens;

(b) activating said laser transmission module to emit a laser beam through said lens and onto a target including indicia;

(c) adjusting a position of said laser transmission module relative to said optics module to project said emitted laser beam onto said target indicia and securing said laser transmission module into that position;

(d) rotating said laser transmission device housing and verifying said emitted laser beam maintains a beam impact location on said target; and (e) adjusting said laser transmission module position relative to said optics module in response to said beam impact location being displaced during said rotation, wherein said laser transmission module position is adjusted in a manner to maintain said beam impact location on said target during said rotation.

56. The method of claim 55, wherein step (c) includes:

(c.1) injecting bonding material into said device housing to secure said laser transmission module in said adjusted module position;

wherein steps (d) and (e) are repeated until expiration of a time interval sufficient for said bonding material to secure said laser transmission module position or until said adjusted laser transmission module position maintains said beam impact location on said target during said rotation.

57. The method of claim 55 wherein said laser transmission module includes at least one position adjustment member, and step (c) includes:

(c.1) adjusting a position of said laser transmission module relative to said optics module via said at least one position adjustment member to project said emitted laser beam onto said target indicia.

58. A laser transmission device for use with a firearm to simulate firearm operation in response to actuation of said firearm by a user comprising:

housing means configured in the form of a firearm cartridge for placement within a firing chamber of said firearm and including:

power means for providing power for said laser transmission device;

transmitting means for emitting a laser beam;

sensing means for detecting actuation of said firearm and producing an actuation signal in response thereto;

modulating means responsive to said actuation signal for applying a modulation signal of a specific frequency to a laser signal of said laser transmitter to emit a modulated laser pulse compatible with an intended target responsive to laser signals modulated at said modulation signal frequency; and optical means for directing said emitted laser pulse from said housing means toward said intended target in a substantially concentric fashion relative to a barrel of said firearm absent alignment of said device with a firearm bore sight.

59. The device of claim 58 wherein said sensing means includes piezoelectric means for producing said actuation signal in response to detecting mechanical waves generated by said firearm actuation and propagating along said firearm.

60. The device of claim 58 wherein said sensing means includes acoustic means for producing said actuation signal in response to detecting acoustic signals generated by said firearm actuation.

61. The device of claim 58 wherein said optical means is positioned within said housing means in a manner to project said emitted laser pulse in a concentric fashion relative to said barrel of said firearm.

62. The device of claim 58 wherein said housing means is configured to be concentric relative to said barrel of said firearm.

63. The device of claim 58 wherein said housing means further includes position means for preventing interference with a firearm extractor and maintaining a position of said device within said firearm during charging of said firearm.

64. A laser transmission device for use with a firearm to simulate firearm operation in response to actuation of said firearm by a user comprising:

housing means configured in the form of a firearm cartridge for placement within a firing chamber of said firearm and including:

power means for providing power for said laser transmission device;

transmitting means for emitting a laser beam;

sensing means for detecting actuation of said firearm and producing an actuation signal in response thereto;

control means for controlling said transmitting means in a manner to emit a laser pulse in response to receiving said actuation signal from said sensing means;

optical means for directing said emitted laser pulse from said housing means toward an intended target in a substantially concentric fashion relative to a barrel of said firearm absent alignment of said device with a firearm bore sight; and position means disposed at a housing means proximal portion and tapering proximally to form a non-intrusive configuration for preventing interference with a firearm extractor and for maintaining a position of said device within said firearm during charging of said firearm.

65. The device of claim 64 wherein said sensing means includes piezoelectric means for producing said actuation signal in response to detecting mechanical waves generated by said firearm actuation and propagating along said firearm.

66. The device of claim 64 wherein said sensing means includes acoustic means for producing said actuation signal in response to detecting acoustic signals generated by said firearm actuation.

67. The device of claim 64 wherein said optical means is positioned within said housing means in a manner to project said emitted laser pulse in a concentric fashion relative to said barrel of said firearm.

68. The device of claim 64 wherein said housing means is configured to be concentric relative to said barrel of said firearm.

69. The device of claim 64 wherein said control means includes modulating means for controlling said transmitting means in a manner to emit a laser pulse modulated at a specific frequency in response to receiving said actuation signal from said sensing means.

70. A laser transmission device for use with a firearm to simulate firearm operation in response to actuation of said firearm by a user comprising:

housing means configured in the form of a firearm cartridge for placement within a firing chamber of said firearm and including:

power means for providing power for said laser transmission device;

transmitting means for emitting a laser beam;

sensor means for detecting actuation of said firearm and producing an actuation signal in response thereto;

control means for controlling said transmitting means in a manner to emit a laser pulse in response to receiving said actuation signal from said sensing means; and optical means for directing said emitted laser pulse from said housing means toward an intended target, wherein said optical means is positioned in a manner to project said emitted laser pulse in a substantially concentric fashion relative to a barrel of said firearm upon insertion of said device into said firing chamber and absent alignment of said device with a firearm bore sight.

71. The device of claim 70 wherein said sensing means includes piezoelectric means for producing said actuation signal in response to detecting mechanical waves generated by said firearm actuation and propagating along said firearm.

72. The device of claim 70 wherein said sensing means includes acoustic means for producing said actuation signal in response to detecting acoustic signals generated by said firearm actuation.

73. The device of claim 70 wherein said housing means is configured to be concentric relative to said barrel of said firearm.

74. The device of claim 70 wherein said housing means further includes position means for preventing interference with a firearm extractor and maintaining a position of said device within said firearm during charging of said firearm.

75. The device of claim 70 wherein said control means includes modulating means for controlling said transmitting means in a manner to emit a laser pulse modulated at a specific frequency in response to receiving said actuation signal from said sensing means.

76. The device of claim 12 wherein said projection includes a groove defined in a proximal surface thereof.

77. The device of claim 14 wherein said projection includes a groove defined in a proximal surface thereof.

* * * * *